US005680768A

United States Patent [19]

Rattray et al.

[11] Patent Number: 5,680,768

[45] Date of Patent: Oct. 28, 1997

[54] CONCENTRIC PULSE TUBE EXPANDER WITH VACUUM INSULATOR

[75] Inventors: Alan A. Rattray, Alta Loma; Steven C. Soloski, Manhattan Beach; Frithjof N. Mastrup, Rancho Palos Verdes, all of Calif.

[73] Assignee: Hughes Electronics, Los Angeles, Calif.

[21] Appl. No.: 590,668

[22] Filed: Jan. 24, 1996

[51] Int. Cl.[6] ..... F25B 9/00

[52] U.S. Cl. ..... 62/6; 62/52.1; 62/520

[58] Field of Search ..... 62/6, 52.1; 60/520

[56] References Cited

U.S. PATENT DOCUMENTS 4,450,693 5/1984 Green et al. ..... 62/52.1

*Primary Examiner*—Henry A. Bennett
*Assistant Examiner*—Pamela A. O'Connor
*Attorney, Agent, or Firm*—Gordon R. Lindeen III; Michael W. Sales; Wanda K. Denson-Low

[57] ABSTRACT

An expander for a concentric pulse tube cooler. The inventive expander includes a central pulse tube; a concentric insulation tube disposed around the central pulse tube, the insulation tube having a concentric chamber therein and the chamber being filled with an insulator and the insulator being atmospheric; and a regenerator disposed around the concentric insulation tube. In a particular implementation, the insulator tube includes a vent which allows the insulation chamber to communicate with the surrounding atmosphere. When used in space, the chamber is filled with a void and the insulator becomes a vacuum and provides effective insulation at cryogenic temperatures. The inventive expander allows for an improved concentric pulse tube cooler design comprising a cold finger assembly disposed at a first end of the concentric pulse tube cooler; a heat exchanger assembly disposed at a second end of the concentric pulse tube cooler; and the pulse tube expander assembly of the present invention secured to the heat exchanger. The expander assembly comprising the central pulse tube; the concentric insulation tube disposed around the central pulse tube having the evacuated insulation chamber therein; and the regenerator disposed around the concentric insulation tube as set forth above.

6 Claims, 3 Drawing Sheets

CONCENTRIC PULSE TUBE EXPANDER WITH VACUUM INSULATOR

BACKGROUND OF THE INVENTION

1. Field of the Invention

The present invention relates to cryogenic cooling devices and systems. More specifically, the present invention relates to pulse tube cryogenic coolers.

2. Description of the Related Art

Cryogenic coolers are well known in the art. These devices are used to cool circuits and systems in many applications including infrared sensing devices implemented in aircraft, spacecraft and numerous other systems. Linear pulse tube cooler construction is typically used in current applications. A linear pulse tube cooler is arranged such that all components of an expander are disposed in a rectilinear arrangement. Consequently, two warm heat exchangers are typically disposed at opposite ends of the expander and a cold station is disposed in the middle. Packaging using conventional linear pulse tubes has therefore often been difficult.

A concentric pulse tube cooler has one integrated warm heat exchanger disposed at one end of the expander and a cold station disposed at the opposite end of the expander in a conventional fashion. The concentric pulse tube expander is easier to package, install and use and it is smaller than current linear pulse tube coolers in size.

Conventional concentric pulse tube expanders did not incorporate an insulator between the pulse tube and the regenerator. It was assumed that the temperature gradient and heat distribution in the pulse tube and the regenerator were similar. However, it has been determined that the temperature distribution in the pulse tube and the regenerator were different. Thermal communication between the pulse tube and the regenerator significantly lowered the efficiency of the pulse tube cooler. Hence, there was a need in the art for a concentric pulse tube cooler with an insulator between the pulse tube and the regenerator.

The need in the art was addressed by the invention of U.S. patent application Ser. No. 08/353,609, entitled CONCENTRIC PULSE TUBE EXPANDER, filed Dec. 12, 1994, by F. N. Mastrup et al., the teachings of which are incorporated herein by reference. While this system is somewhat effective, it utilizes a plastic insulator which does conduct some heat at cryogenic temperatures which appears as a loss in efficiency.

Thus, a need remains in the art for a concentric pulse tube cooler with an improved insulator between the pulse tube and the regenerator which afforded greater reliability at cryogenic temperatures.

SUMMARY OF THE INVENTION

The need in the art is addressed by the present invention which provides an expander for a concentric pulse tube cooler. The inventive expander includes a central pulse tube; a concentric insulation tube disposed around the central pulse tube, the insulation tube having a concentric chamber therein and the chamber being filled with an insulator and the insulator being atmospheric; and a regenerator disposed around the concentric insulation tube.

In a particular implementation, the insulator tube includes a vent which allows the insulation chamber to communicate with the surrounding atmosphere. When used in space, the chamber is filled with a void and the insulator becomes a vacuum and provides effective insulation at cryogenic temperatures.

The inventive expander allows for an improved concentric pulse tube cooler design comprising a cold finger assembly disposed at a first end of the concentric pulse tube cooler; a heat exchanger assembly disposed at a second end of the concentric pulse tube cooler; and the pulse tube expander assembly of the present invention secured to the heat exchanger. The expander assembly comprising the central pulse tube; the concentric insulation tube disposed around the central pulse tube having the evacuated insulation chamber therein; and the regenerator disposed around the concentric insulation tube as set forth above.

BRIEF DESCRIPTION OF THE DRAWINGS

FIG. 4 is a diagram of a cooling system utilizing the concentric pulse tube cryogenic cooler of the present invention.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
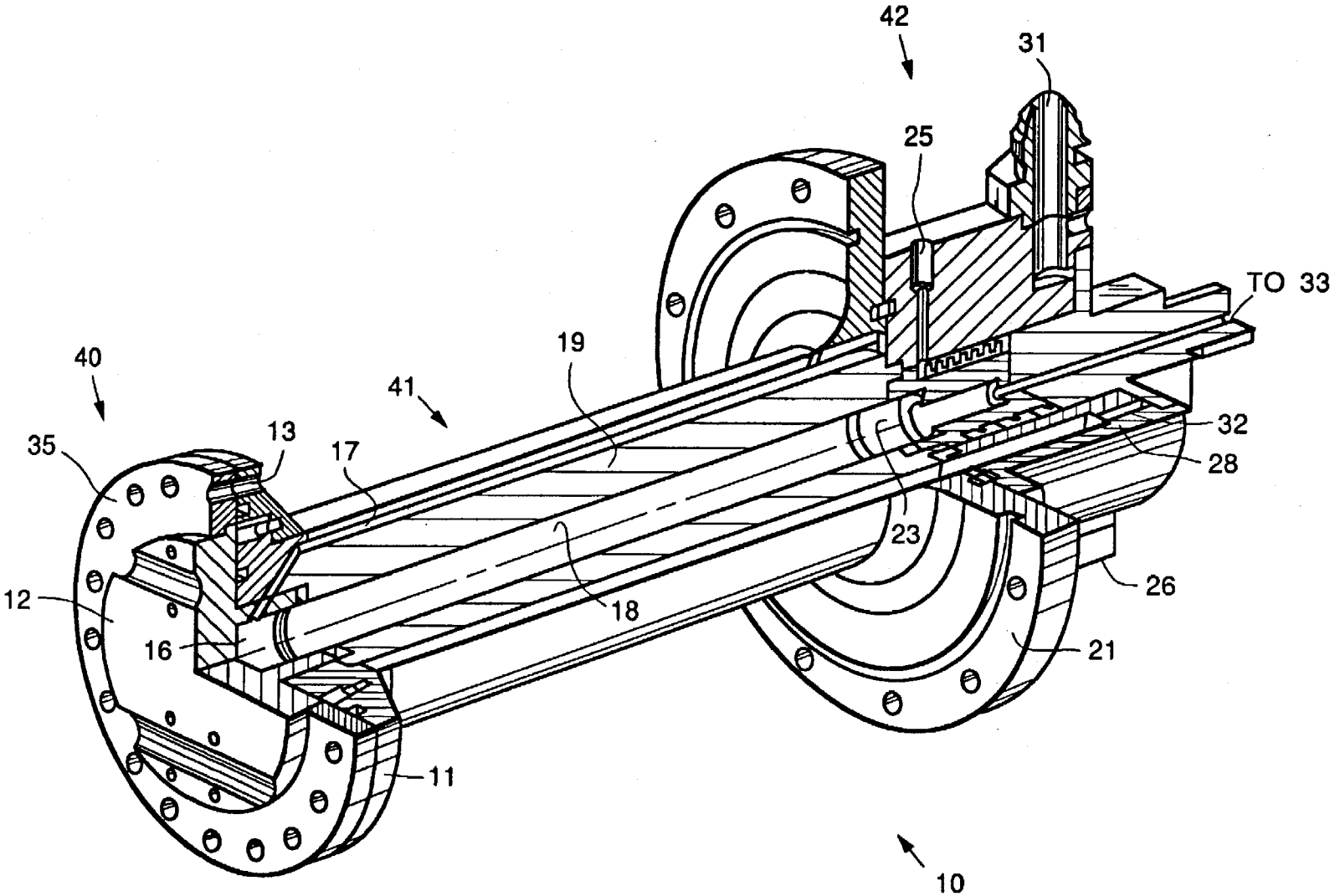
FIG. 1 is a perspective view, partially cutaway, of a concentric pulse tube cooler with a concentric solid insulator.

FIG. 1 is a perspective view, partially cutaway, of a concentric pulse tube cooler with a concentric solid insulator.

Figure 2:
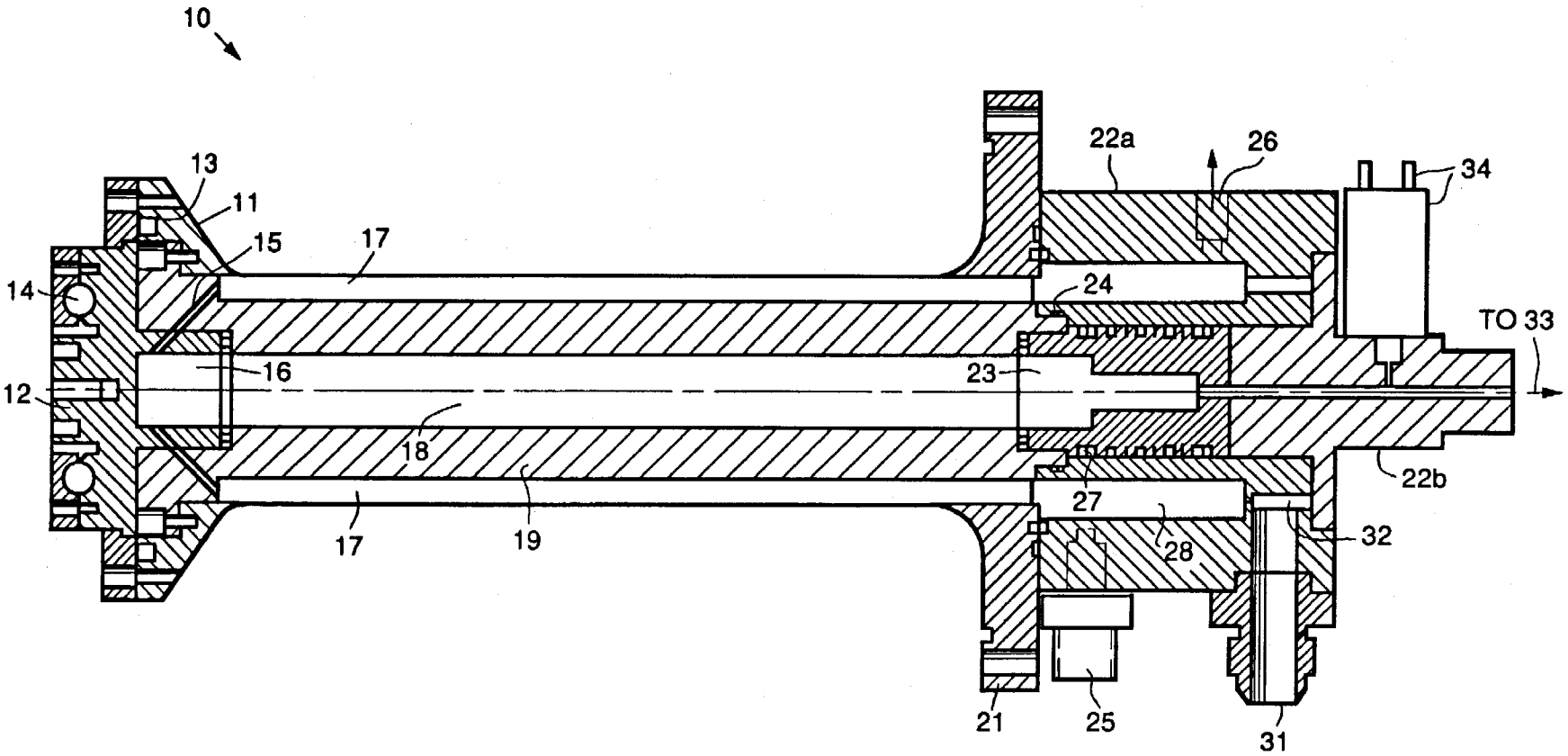
FIG. 2 is an enlarged cross-sectional view of the concentric pulse tube cooler of FIG. 1.

FIG. 2 is an enlarged cross-sectional view of the concentric pulse tube cooler of FIG. 1. The cooler shown in FIGS. 1 and 2 is disclosed and claimed in the above-referenced U.S. patent application Ser. No. 08/353,609, entitled CONCENTRIC PULSE TUBE EXPANDER, filed Dec. 12, 1994, by F. N. Mastrup et al., the teachings of which are incorporated herein by reference. A review of these design facilitates an understanding of the cooler of the present invention as set forth more fully below.

As illustrated in FIGS. 1 and 2, the concentric pulse tube cooler 10 includes three subassemblies: a cold finger assembly 40, a pulse tube expander assembly 41, and a dual heat exchanger assembly 42. The cold finger assembly 40 is comprised of a cold finger 12 and a cold end heat exchanger 16 disposed in an axially extended portion of the cold finger 12. The cold finger 12 may be copper or other suitable material. The heat exchanger 16 may be 100 mesh copper screen or other suitable material.

The pulse tube expander assembly 41 is comprised of a central pulse tube 18 surrounded by a concentric insulation tube 19. The insulation tube 19 is surrounded by a concentric regenerator 17. The concentric regenerator 17 may be 400 mesh stainless steel or other suitable material. The central pulse tube 18, insulation tube 19 and regenerator 17 are secured within a housing 11. A plurality of cold finger coupling channels 15 are disposed through the insulation tube 19 and cold finger that couple the regenerator 17 to the cold end heat exchanger 16.

A flange 35 disposed at one end of the pulse tube expander assembly 41 adjacent to the cold finger that is used to secure the cold finger assembly 40 to the housing 11 of the pulse tube expander assembly 41. A vacuum interface flange 21 is disposed at an opposite end of the pulse tube expander assembly 41 distal from the cold finger assembly 40 and adjacent the heat exchanger assembly 42 that is used to secure the concentric pulse tube expander assembly 41 to the heat exchanger assembly 42 and to a vacuum source (not shown) for a vacuum dewar that insulates the cold finger.

The concentric pulse tube expander assembly 41 has a thermal insulator provided by the insulation tube 19 that separates the central pulse tube 18 from the concentric regenerator 17.

The pulse tube expander assembly 41 is slideably secured to the heat exchanger assembly 42 by means of a slideable axial seal 24 that is provided by a viton O-ring, for example. The slideable axial seal 24 permits relative motion between the cold finger assembly 40 and pulse tube expander assembly 41 toward the heat exchanger assembly 42 as the cold finger 12 and expander assembly 41 cool down.

The heat exchanger assembly 42 is comprised of an outer heat exchanger housing **22*a* and an axial rejection heat exchanger housing 22*b*. An axially-located rejection heat exchanger 23 is disposed in the axial rejection heat exchanger housing 22*b* and a primary heat exchanger 28, that abuts an end of the regenerator 17, is disposed in the outer heat exchanger housing 22*a*. The rejection heat exchanger 23 may be comprised of 100 mesh copper screen or other suitable material. The primary heat exchanger 28** may also be 100 mesh copper screen or other suitable material.

A coolant channel 27 is formed in the heat exchanger assembly 42 between and through the outer heat exchanger housing **22*a* and the axial heat exchanger housing 22*b*, that includes a spiral channel 27 that is coupled between a coolant inlet port 25 and a coolant outlet port 26. A coolant, such as water, for example, is caused to flow through the coolant channel 27 between the coolant inlet port 25 and the coolant outlet port 26**.

For laboratory measurements, a pressure transducer is coupled to a port in the axial heat exchanger housing **22*b* that senses pressure in the line between the central pulse tube 18 and the surge volume 33. The outer heat exchanger housing 22*a* has a gas inlet port 31 that is coupled to a circular gas inlet and outlet plenum 32 that couples the operating gas into the heat exchanger 28, then into the concentric regenerator 17, through the cold end heat exchanger 16, into the central pulse tube 18 through the rejection heat exchanger 23, to the surge volume 33** and then return.

As mentioned above, the solid insulator 19 of the cooler 10 of FIGS. 1 and 2 while somewhat effective, does create a loss of efficiency. The cooler of the present invention eliminates the solid insulation in favor of more effective vacuum insulation.

Figure 3:
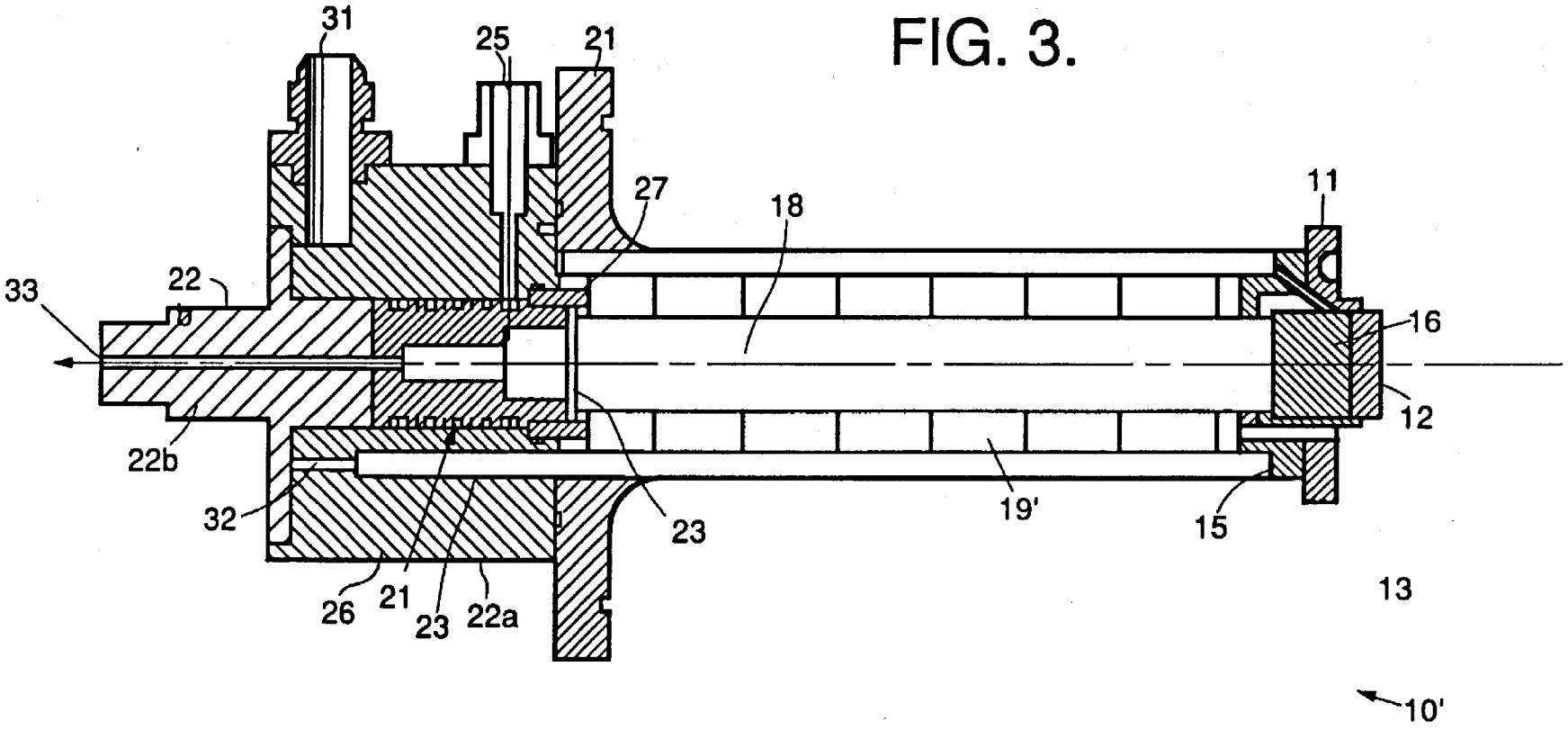
FIG. 3 is a sectional side view of the concentric pulse tube cryogenic cooler of the present invention.

FIG. 3 is a sectional side view of the concentric pulse tube cryogenic cooler of the present invention. The inventive cooler 10' is similar in design and construction to that of FIGS. 1 and 2 with the exceptions that the insulator 19 of FIGS. 1 and 2 is replaced by a concentric chamber 19' and the chamber 19' is connected to atmosphere by a vent 20. When used in space, the configuration of the present invention allows for the chamber 19' to be filled with a vacuum via the vent 20. The vent 20 extends through the coupling channel 15 and the housing 11. The vent 20 creates a vacuum insulator in the concentric chamber 19' between the regenerator 17 and the pulse tube 18.

FIG. 4 is a diagram of a cooling system utilizing the concentric pulse tube cryogenic cooler of the present invention. The system 100 includes the concentric pulse tube expander 10' of the present invention which is driven by a conventional compressor 110 under control of an electronic subassembly 120 to provide a cold tip at an interface 130.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An expander for a concentric pulse tube cooler comprising:

a central pulse tube;

a concentric insulation tube disposed around the central pulse tube, the insulation tube having a concentric chamber therein;

a regenerator disposed around the concentric insulation tube; and a housing within which said insulation tube is disposed, said housing having a vent therethrough by which the chamber is in communication with a surrounding atmosphere.

2. A concentric pulse tube cooler comprising:

a cold finger assembly disposed at a first end of the concentric pulse tube cooler;

a heat exchanger assembly disposed at a second end of the concentric pulse tube cooler; and a pulse tube expander assembly secured to the heat exchanger, the expander assembly comprising:

a central pulse tube;

a concentric insulation tube disposed around the central pulse tube, the insulation tube having a concentric chamber therein and the chamber being filled with an insulator and the insulator being atmospheric; and a regenerator disposed around the concentric insulation tube.

3. The invention of claim 2 wherein the chamber is void whereby the insulator is a vacuum.

4. The invention of claim 2 wherein the cooler is disposed within a housing and the housing has a vent therethrough by which the chamber is in communication with a surrounding atmosphere.

5. The invention of claim 4 wherein the surrounding atmosphere is free space such that the chamber is void whereby the insulator is a vacuum.

6. A cooling system comprising:

a concentric pulse tube cooler having:

a cold finger assembly disposed at a first end of the concentric pulse tube cooler, a heat exchanger assembly disposed at a second end of the concentric pulse tube cooler, and a pulse tube expander assembly secured to the heat exchanger, the expander assembly having:

a central pulse tube, a concentric insulation tube disposed around the central pulse tube, the insulation tube having a concentric chamber therein and the chamber being filled with an insulator and the insulator being atmospheric, and a regenerator disposed around the concentric insulation tube;

a compressor connected to said cooler; and means for controlling said compressor in response to the temperature at said cold finger.

* * * * *